United States Patent [19]

Sieurin

[11] 4,129,023

[45] Dec. 12, 1978

[54] ROLLING MILL

[75] Inventor: Donald Sieurin, Shrewsbury, Mass.

[73] Assignee: Morgan Construction Company, Worcester, Mass.

[21] Appl. No.: 841,166

[22] Filed: Oct. 11, 1977

[51] Int. Cl.[2] ..... B21B 35/02; B21B 1/18

[52] U.S. Cl. ..... 72/235; 72/249

[58] Field of Search ..... 72/235, 234, 249, 248, 72/244, 240

[56] References Cited

U.S. PATENT DOCUMENTS

| | | | |
|---|---|---|---|
| 1,858,990 | 5/1932 | Foren | 72/235 X |
| 2,664,019 | 12/1953 | Henderson | 72/249 X |
| 3,505,851 | 4/1970 | Alvarez | 72/249 |
| 3,776,014 | 12/1973 | Artz et al. | 72/249 |

*Primary Examiner*—Milton S. Mehr

*Attorney, Agent, or Firm*—Thompson, Birch, Gauthier & Samuels

[57] ABSTRACT

In a rolling mill having a plurality of roll stands aligned along the mill pass line, each roll stand having parallel roll shafts carrying cooperating pairs of work rolls, with the roll shafts of at least some of the roll stands being offset 90° with respect to the roll shafts of the other roll stands in order to eliminate the necessity for twisting the product as it progresses from stand to stand along the mill pass line, an apparatus for driving the roll shafts consisting of intermeshed gears carried by each pair of roll shafts for establishing a drive connection therebetween; a driven sprocket wheel connected to one roll shaft of each pair; a gear unit for each roll stand, each gear unit having an input shaft and an output shaft, the output shaft of each gear unit being parallel to the roll shafts of the roll stand associated therewith and having a driving sprocket wheel thereon; and endless chains for connecting the driving and driven sprocket wheels, the input shafts of the gear units being interconnected along a single drive line parallel to the mill pass line and being driven by a common power source.

5 Claims, 7 Drawing Figures

Fig., 4

ROLLING MILL

DESCRIPTION OF PREFERRED EMBODIMENT

This invention relates to rolling mills wherein two groups of roll stands are arranged in block form to roll a single product strand, with the roll shafts of one group of roll stands being offset 90° in relation to the roll shafts of the other group of roll stands in order to eliminate the necessity for twisting the product as it progresses from stand to stand along the mill pass line.

This type of rolling mill is now well known to those skilled in the art, as evidenced for example by the disclosures in U.S. Pat. Nos. RE 28,107; 3,776,014; 3,610,014 and British Patent No. 1,281,404. Each of the drive arrangements for these mills includes a pair of line shafts, one for each of the aforesaid roll stand groups. The line shafts are parallel to the mill pass line and are interconnected by a gear box to a common power source. Each pair of roll shafts has a pair of intermediate drive shafts associated therewith. The intermediate drive shafts are connected to each other and to the roll shafts by gear clusters, and one intermediate drive shaft of each pair is connected to its associated line shaft by a bevel gear set.

This type of drive arrangement is particularly suited for, although not limited to, high speed applications such as for example the rolling of steel rod. However, for other applications such as the rolling of non-ferrous products where operating speeds are lower, this type of drive arrangement is in some instances considered to be unnecessarily complex and expensive, due in large part to the rather extensive use of intermediate drive shaft pairs and their associated gear clusters, the multiple line shafts, and the large number of bearings needed to support the intermediate drive shafts and multiple line shafts. It has not heretofore been thought possible to achieve needed design simplifications and economics of manufacture without also penalizing reliability of operation and ease of maintenance.

Accordingly, a primary objective of the present invention is the provision of a less complex and more economical drive system for rolling mills of the above-described type, without penalizing reliability of operation or ease of maintenance.

Another object of the present invention is the provision of a drive system for rolling mills of the above-described type which is characterized by a single drive line formed by the interconnected input shafts of a plurality of gear units, and by a direct connection between the output shafts of said gear units and a roll shaft of each roll pair, thereby obviating the use of intermediate drive shafts.

A further object of the present invention is the elimination of gear clusters and intermediate drive shafts in the drive connection between each roll shaft pair and the driving line parallel to the mill pass line.

These and other objects and advantages of the present invention will become more apparent as the description proceeds with the aid of the accompanying drawings, wherein.

Figure 1:
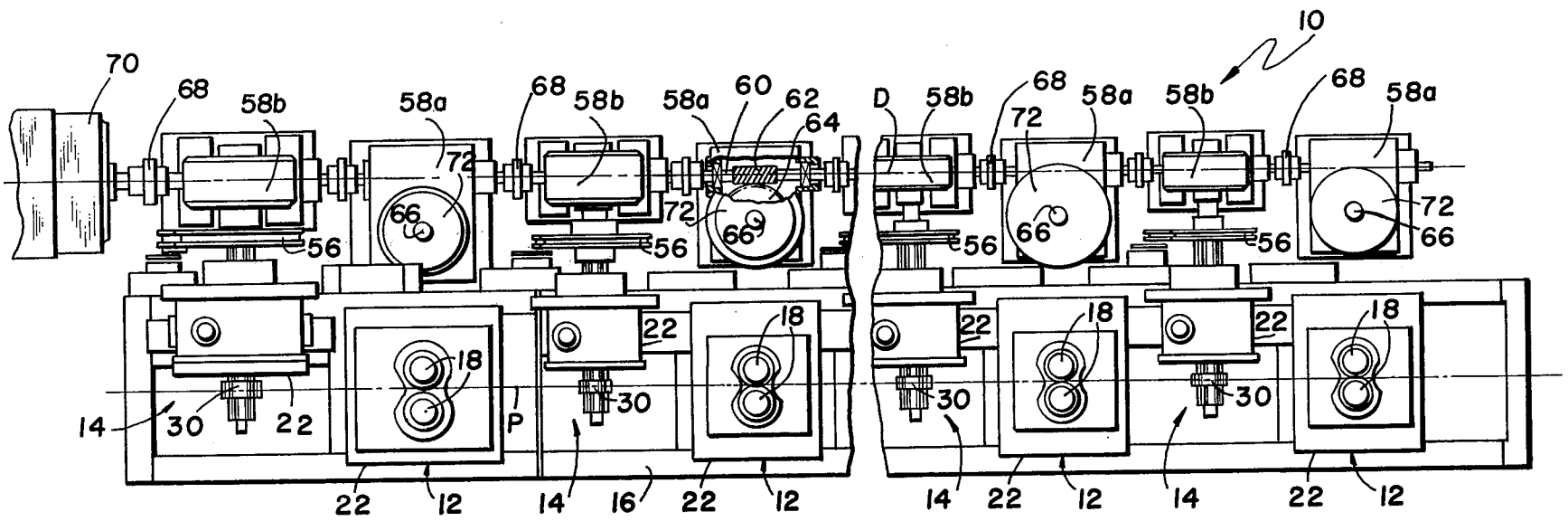
FIG. 1 is a plan view of a rolling mill embodying the concepts of the present invention without protective hoods and shielding, and with portions broken away in order to better illustrate interior components.
Figure 2:
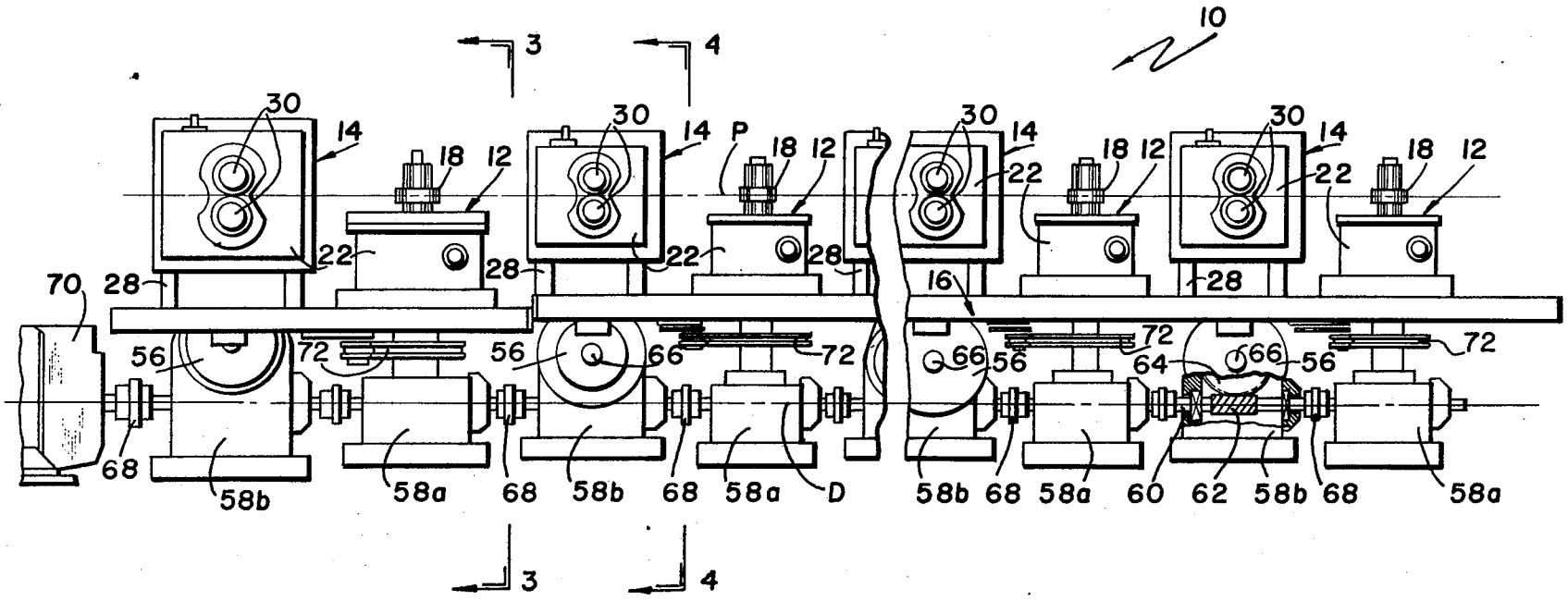
FIG. 2 is a side elevational view of the apparatus shown in FIG. 1, again with portions broken away.
Figure 3:
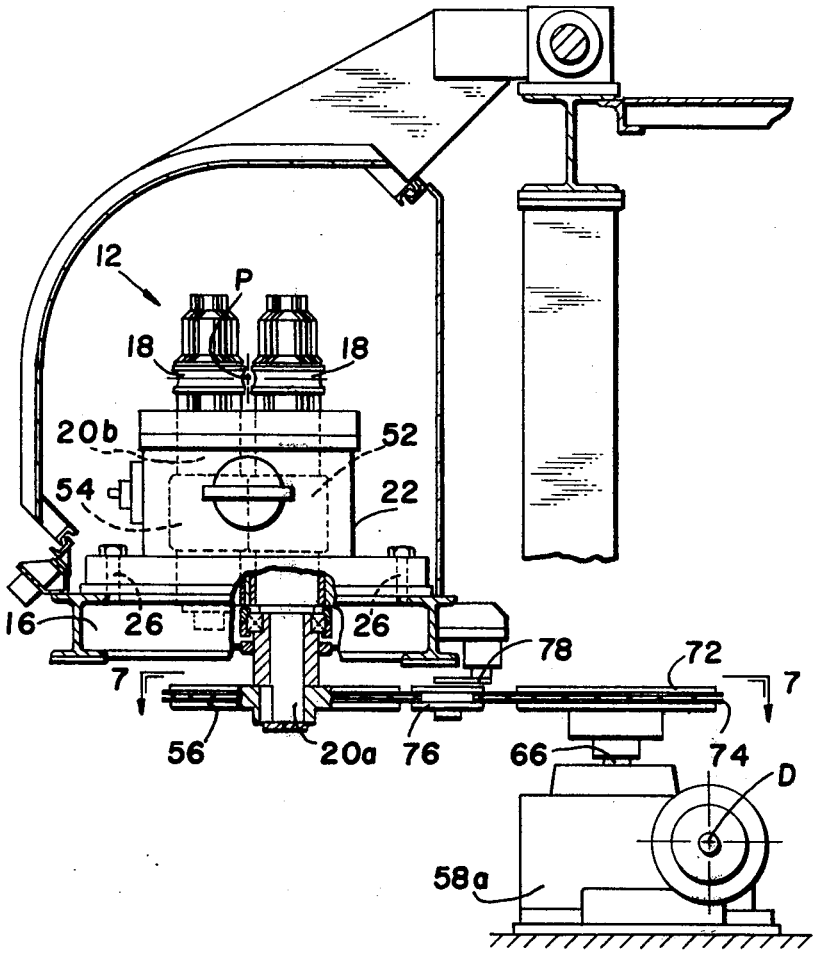
Figure 4:
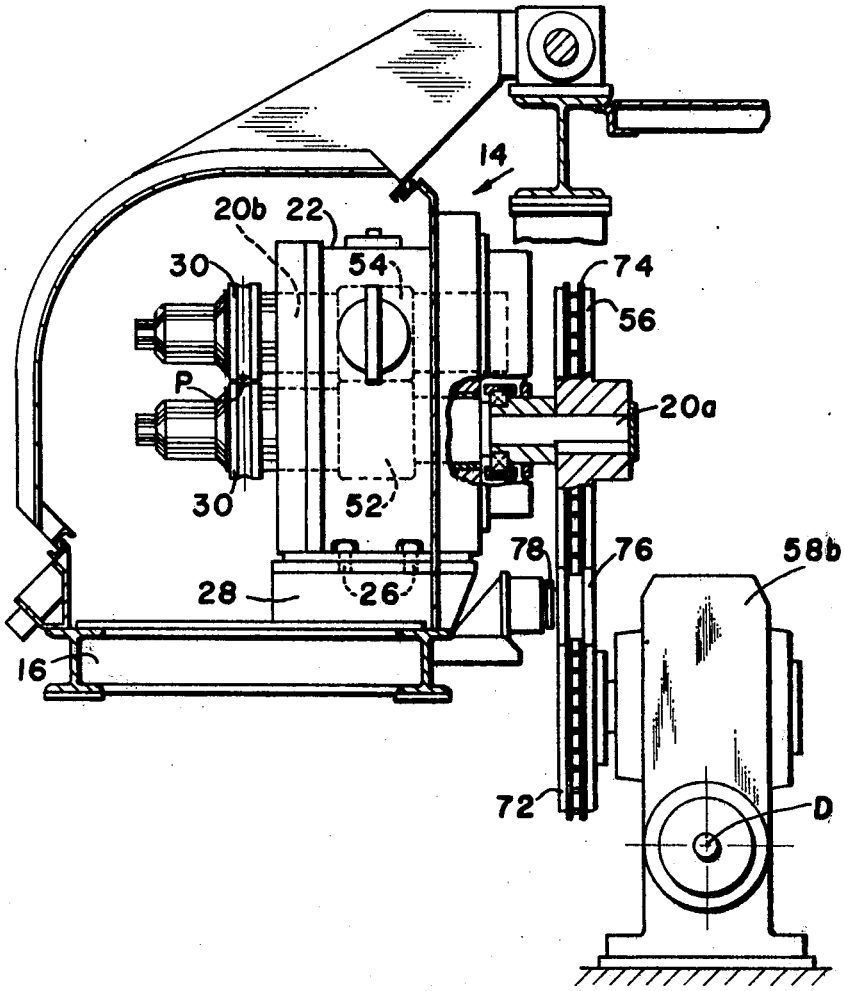
Figure 5:
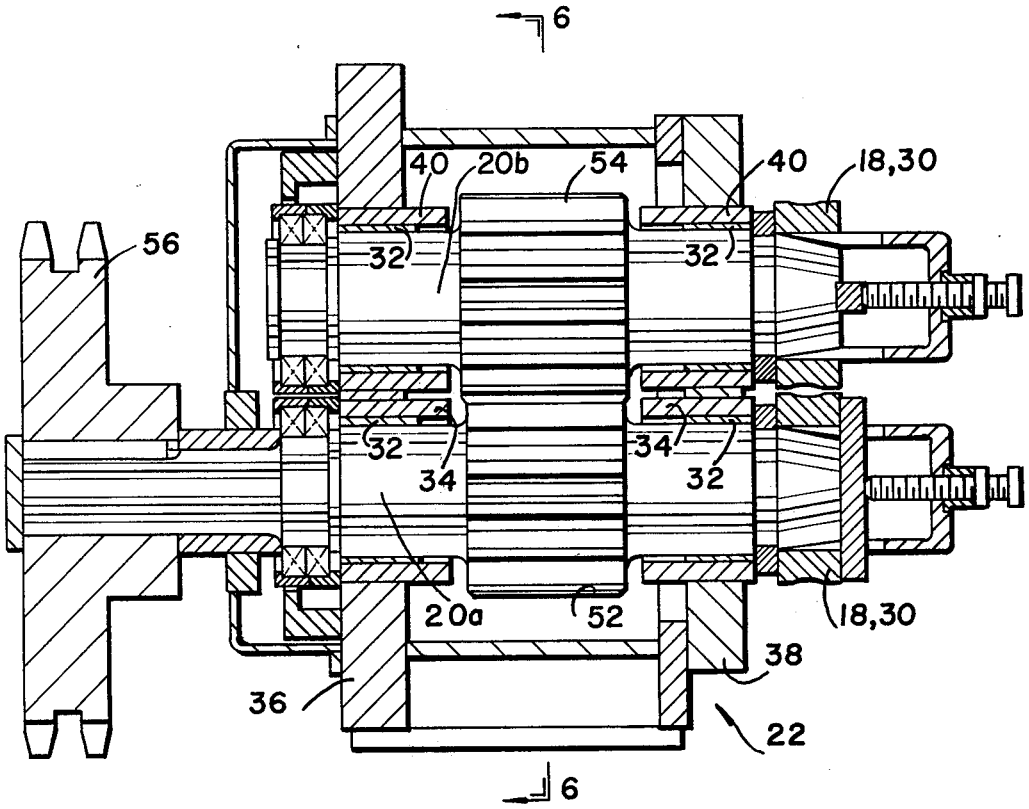
Figure 6:
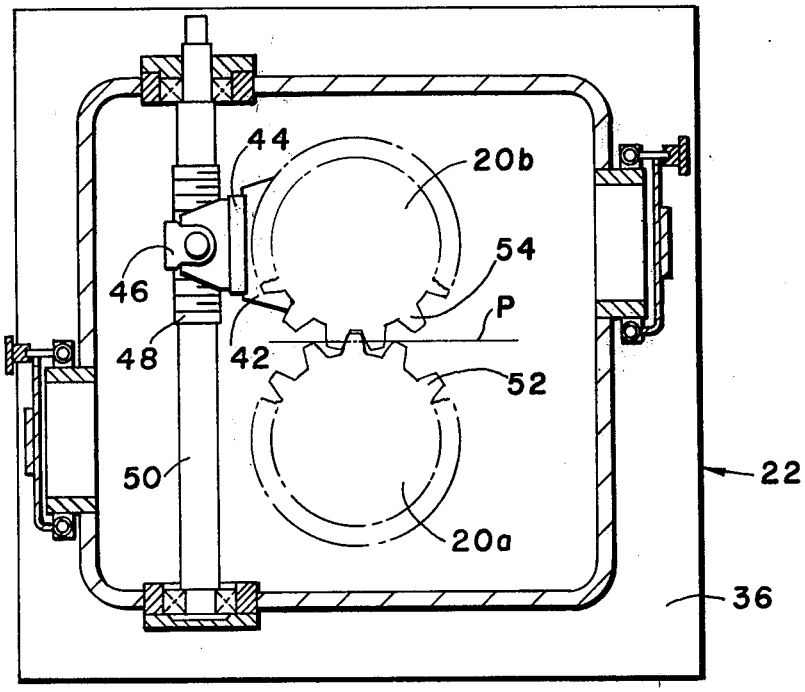
Figure 7:
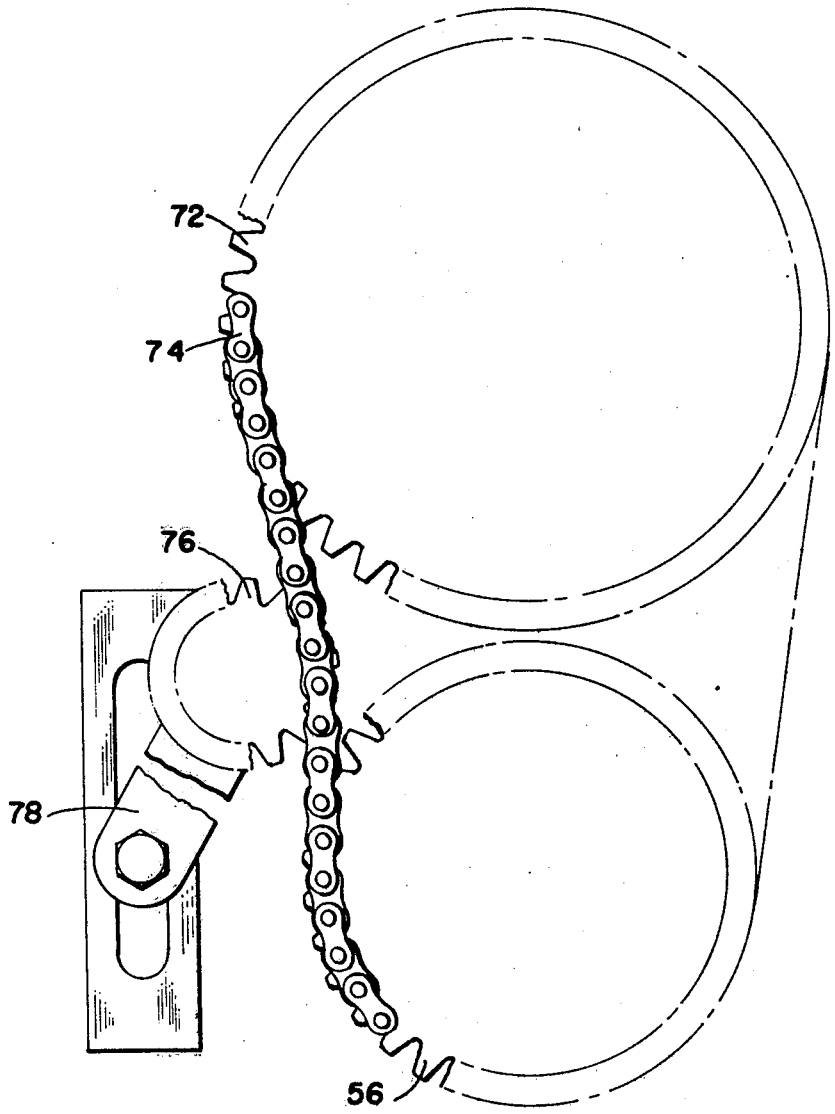

FIGS. 3 and 4 are sectional views on an enlarged scale taken along lines 3—3 and 4—4 of FIG. 2 with protective hoods and shielding;

FIG. 5 is a sectional view on an enlarged scale taken through a typical roll and pinion housing;

FIG. 6 is a sectional view taken along lines 6—6 of FIG. 5; and,

FIG. 7 is a schematic sectional view taken along lines 7—7 of FIG. 3.

Referring now to the drawings, there is generally indicated at 10 a rolling mill wherein two groups of roll stands 12 and 14 are arranged in block form on a common integral bed plate 16 to roll a single product strand along the mill pass line "P."

As is best shown in FIG. 3, the roll stands 12 have roll discs 18 mounted in cantilever fashion on the ends of the vertically arranged parallel roll shafts **20*a*, 20*b* of a standard roll and pinion housing 22. At each stand 12, housing 22 is fastened as at 26 to the horizontal bed plate 16**.

As shown in FIG. 4, each of the other roll stands 14 has a horizontally stepped support surface 28 to which the standard roll and pinion housing 22 is fastened as at 26. The roll stands 14 also have cantilevered roll discs 30 on the horizontally disposed roll shafts **20*a*, 20*b*. With this arrangement of roll stands 12, 14 and their vertical and horizontal roll discs 18, 30**, the product can progress from stand to stand along the mill pass line P without twisting.

It will be understood, however, that the roll shafts **20*a*, 20*b* of the roll stands 12, 14 need not be respectively vertical and horizontal as herein illustrated. As long as the roll shafts of the stands 12 and 14** are offset 90° to each other, they may be inclined at any appropriate angle, for example at 45° with respect to the vertical and horizontal.

Referring now to FIGS. 5 and 6, which are sectional views taken through a typical standard roll and pinion housing 22 removed from the mill, it will be seen that the roll shaft **20*a* is journalled for rotation about a fixed axis between sleeve bushings 32 contained in non-rotatable concentric sleeves 34 supported by the housing end plates 36, 38. In contrast, roll shaft 20*b* is journalled between similar sleeve bushings 36 contained in eccentric sleeves 40 rotatably supported by the same housing end plates. The eccentric sleeves 40 have lateral arms 42 which are interconnected by a transverse member 44 supporting a nut 46 which engages a threaded portion 48 on a spindle 50. Rotation of the spindle 50 thus produces rotation of the eccentric sleeves 40, and this in turn adjusts the rotational axis of shaft 20*b* relative to that of shaft 20*a*. In this manner, the parting between the roll disc pairs 18 or 30** can be adjusted both prior to and during operation of the mill.

Each fixed roll shaft **20*a* carries a gear 52 which is in meshed relationship with a gear 54 on the adjustable roll shaft 20*b*. The meshed relationship between the gears 52, 54 is changed but not adversely affected by roll parting adjustments. A driven sprocket wheel 56 is mounted on one end of the fixed shaft 20*a* for rotation therewith. When the housings 22 are mounted on the roll stands 12, the sprocket wheels 56 are horizontally arranged, whereas when the housings 22 are mounted on the roll stands 14, the sprocket wheels 56** are vertically arranged.

The roll stands 12, 14 have gear units **58*a*, 58*b* respectively. Each gear unit has an input shaft 60 carrying a worm 62 in meshed relationship with a worm gear 64 on an output shaft 66 which is parallel to the roll shafts 20***a*, 20*b* of the roll stand associated therewith. The input and output shafts are arranged at right angles to each other. The input shafts 60 of the gear units 58*a*, 58*b* are interconnected by couplings indicated typically at 68 along a single drive line "D" parallel to the mill pass line "P". All gear units are driven by a common power source, for example motor 70, with the successive ratios of the gear units being progressively stepped to accommodate the increasing speed of the product as it passes through the mill. The output shafts 66 of the gear units 58*a*, 58*b* have driving sprocket wheels 72 mounted on the ends thereof. The output shafts 66 of the gear units 58*a* are parallel to the roll shafts of roll stands 12, and likewise the output shafts 66 of the gear units 58*b* are parallel with the roll shafts of the roll stands 14.

The driving sprocket wheels 72 of the gear units 58*a*, 58*b* are connected to the driven sprocket wheels 56 of the roll stands associated therewith by endless flexible chains 74. As is best shown in FIG. 7, each chain 74 is tensioned by an idler sprocket 76 which is carried on the end of a pivotally adjustable lever 78.

It will thus be seen that the above-described arrangement embodies a number of advantageous features. To begin with, by arranging all of the gear units 58*a*, 58*b* along a single drive line "D" there is no need to provide a connecting gear box of the type required to interconnect the multiple drive lines of known prior art arrangements. The elimination of the connecting gear box represents a significant cost saving. Further cost savings are realized by connecting the output shafts 66 of the gear units 58*a*, 58*b* to the fixed roll shaft 20*a* by means of sprocket wheels 56, 72 and chains 74. This arrangement obviates the necessity for employing intermediate drive shafts, gear clusters and associated bearings, all of which are relatively expensive components.

The chain drive arrangement does not limit or in any way complicate the interchangeability of the components. The roll shafts and their intermeshed gears, together with their roll parting adjustment means are contained in standard housings which may be interchangeably mounted at a plurality of locations along the mill, either on stands 12 or stands 14. When a change of housings is required, chain tension is relaxed by an appropriate adjustment of the idler sprocket 76. Thereafter, the chain 74 is disconnected from the driven sprocket wheel 56 and after removing the fasteners 26, the housing is simply lifted away and replaced with another.

In light of the foregoing, certain changes and modifications will now suggest themselves to those skilled in the art. For example, under certain circumstances it might be possible to replace the disclosed sprocket wheels and chains with sheaves and belts. The number and angular arrangement of stands in a given block can be varied to suit operating requirements.

It is my intention to cover these and any other changes or modifications of the embodiment herein chosen for purposes of disclosure which do not depart from the spirit and scope of the invention.

I claim:

1. In a rolling mill having a plurality of roll stands aligned along the mill pass line, each roll stand having parallel roll shafts carrying cooperating pairs of work rolls, with the roll shafts of at least some of said roll stands being offset angularly with respect to the roll shafts of the other of said roll stands in order to eliminate the necessity for twisting the product as it progresses from stand to stand along the mill pass line, apparatus for driving said roll shafts comprising: intermeshed gear means carried by each pair of roll shafts for establishing a drive connection therebetween; a driven wheel connected to one roll shaft of each pair; a gear unit for each roll stand, each gear unit having an input shaft and an output shaft, the output shaft of each gear unit being parallel to the roll shafts of the roll stand associated therewith and having a driving wheel thereon; flexible endless means for connecting said driving and driven wheels, the input shafts of said gear units being interconnected along a single drive line parallel to the mill pass line and being driven by a common power source.

2. The apparatus of claim 1 wherein said driving and driven wheels are provided with sprockets, and wherein said flexible endless means comprise chains engageable with said sprockets.

3. The apparatus of claim 1 wherein one roll shaft of each pair of rotatable about a fixed axis and the other roll shaft of each pair is adjustable to vary the gap between the work rolls mounted thereon, the said driven wheels being connected to the roll shafts which are rotatable about fixed axes.

4. The apparatus of claim 1 wherein the input and output shafts of said gear units are arranged at right angles to each other and interconnected by means of a worm gear and an endless screw.

5. The apparatus of claim 1 further comprising adjustment means for moving one roll shaft of each pair relative to the other roll shaft of the same pair in order to vary the gap between the work rolls mounted thereon, the said roll shafts, intermeshed gear means and adjustment means comprising standard assemblies contained in housings which may be interchangeably mounted on a plurality of said roll stands.

* * * * *